US007645347B2

(12) United States Patent
Saik

(10) Patent No.: US 7,645,347 B2
(45) Date of Patent: Jan. 12, 2010

(54) MOBILE CHEMICAL MIXING AND INJECTION UNIT AND METHOD FOR USING THE SAME

(76) Inventor: Larry Saik, PO Box 99, Innisfree, Alberta (CA) T0B 2G0

( * ) Notice: Subject to any disclaimer, the term of this patent is extended or adjusted under 35 U.S.C. 154(b) by 449 days.

(21) Appl. No.: 10/904,698

(22) Filed: Aug. 17, 2005

(65) Prior Publication Data

US 2006/0107978 A1 May 25, 2006

(30) Foreign Application Priority Data

Nov. 23, 2004 (CA) ..... 2486137

(51) Int. Cl.
*B08B 3/10* (2006.01)

(52) U.S. Cl. ..... 134/169 R; 134/167 R; 134/177

(58) Field of Classification Search ..... 134/167 R, 134/169 R, 177
See application file for complete search history.

(56) References Cited

U.S. PATENT DOCUMENTS 1,836,674 A * 12/1931 Little et al. ..... 96/168
3,041,267 A * 6/1962 Frame et al. ..... 208/390
4,945,933 A * 8/1990 Krajicek et al. ..... 134/167 R
5,421,903 A * 6/1995 Manabe et al. ..... 134/22.1
5,433,863 A * 7/1995 Braden et al. ..... 210/708
5,582,652 A * 12/1996 Robertson et al. ..... 134/22.12

* cited by examiner

*Primary Examiner*—Joseph L Perrin
(74) *Attorney, Agent, or Firm*—Gordon Thomson

(57) ABSTRACT

A mobile chemical mixing and injection unit adapted for use during the extraction of an oil/water/sand slurry from an oil field storage tank wherein said tank has a body of accumulated sand therein. The unit comprises a motorized truck body having a flat bed with a water storage tank and two mixing tanks mounted thereto. A high pressure injection pump pumps water from the water storage tank to the oil field storage tank and creates a slurry. The slurry is pumped to an adjacent settlement tank hopper where the oil, water and sand will stratify. An effective amount of a flocculating agent, coagulating and surfactant are mixed in each of the water filled mixing tanks and then pumped into the slurry to facilitate separation of oil, sand and water. The high pressure injection water and the water for the mixing tanks are replenished by pumping water from the settlement tank hopper thereby ensuring a continuous process until the field storage tank is cleaned.

2 Claims, 14 Drawing Sheets

MOBILE CHEMICAL MIXING AND INJECTION UNIT AND METHOD FOR USING THE SAME

CROSS-REFERENCE TO RELATED APPLICATIONS

This application is related to my co-pending patent application "Trailer Mounted Mobile Apparatus for Dewatering and Recovering Formation Sand" having a filing date of Oct. 29, 2003 and a Ser. No. 10/694,716.

REFERENCE TO MICROFICHE APPENDIX

Not applicable.

FIELD OF THE INVENTION

This invention pertains to an apparatus for mixing and adding colloidal agents to oil, water, and solid mixture in order to separate oil from said mixture. More particularly this invention relates to a mobile apparatus for mixing colloidal agents and injecting them into an oil field storage tank effluent stream in order to ultimately separate the effluent stream into constituent parts of water, oil and sand for recovery and recycling.

BACKGROUND OF THE INVENTION

Oil that is pumped from a producing oil formation at a remote well head is often stored on-site in a tank. The oil often contains large amounts of water and formation sand or proppant/frac sand. Over time, the oil, water and solid phases will separate out. The sand will collect at the bottom of the tank and the oil will float on top of the water. Other particulate matter such as shale and clay may also accumulate. A significant amount of oil may remain emulsified in the water and adsorbed on the particulate matter. In a typical field oil storage tank in the region of Innisfree, Saskatchewan, Canada, the non-aqueous components may have the following composition:

TABLE 1

| | |
|---|---|
| Oil/paraffin | 17.65% |
| Asphaltene | 1.81% |
| Carbonates | 0.34% |
| Iron salts | 0.68% |
| Insolubles | 79.52% |

The insolubles consist primarily of silica sand.

To further collect and process the oil, it is necessary to separate the water and sand from the oil. The water and sand present disposal problems that must be addressed in a cost efficient and ecologically sound manner. Separating the sand and water from the oil waste has a number of advantages including recovery of a reusable product, reduction of waste storage costs and mitigation of toxic waste pollution. Major hydrocarbon producers are under increasing public and regulatory pressure to conduct their businesses in a manner that is as environmentally benign as possible. This has created a problem that was heretofore addressed by burying the mixtures or spreading the mixture on rural roads as a dust control agent. Since, burying or long-term storage is not longer a feasible solution, there has been created an imperative to resolve this issue.

This problem was partially solved by my invention entitled "Treatment of Oil, Water and Sand Mixtures" described in my Canadian Patent 2,196,522. This invention provides for chemical addition and describes a method and apparatus for treating oil, water and sand mixtures into separate components. However, this invention was designed to be stationary and feedstock has to be transported to the treatment site. Due to the remote nature of many oil and gas well fields, trucking oil, water and sand mixtures to a separation plant is prohibitively expensive. My co-pending patent application "Trailer Mounted Mobile Apparatus for Dewatering and Recovering Formation Sand" having a filing date of Oct. 29, 2003 and a Ser. No. 10/694,716, incorporated herein by reference addresses the problem of removing and dewatering sand from remote oil field storage tanks. However, it does not directly address the requirement of treating oil field storage tank effluent by chemical means to further promote separation of oil, sand and water. The additional of chemicals to the effluent from storage tanks is necessary in order for the process to work effectively.

Therefore, there continues to be a need, not heretofore known in the prior art, of a self-contained mobile chemical mixing and injection unit and method for using the same to enhance the remote processing of oil field storage tank effluent and in order to promote separation of sand, oil and water.

SUMMARY OF THE INVENTION

The present invention relates to a mobile chemical mixing and injection unit that is used to mix and inject chemicals into a slurry effluent comprising oil, water and sand in order to promote the separations of these components in an adjacent mobile dewatering apparatus as described in my co-pending invention referenced herein or in a mobile settling tank not having the features of my co-pending invention.

In a preferred embodiment of the present invention, the unit comprises:

a mobile platform comprising a motorized truck body having a flat bed;

a first, second and third fluid holding tanks mounted to the flat bed, wherein each fluid holding tank has a fluid outlet and an isolation valve;

means for injecting high pressure water into a body of accumulated sand within an oil field storage tank thereby creating a slurry;

means for transporting the slurry to the mobile dewatering apparatus or mobile settling tank;

means for mixing chemicals into an aqueous chemical solution; and, means for injecting the aqueous chemical solution into the slurry prior to transporting the slurry to the mobile dewatering apparatus or mobile settling tank.

The unit may also be mounted to a towed flat bed trailer instead of a truck.

The first holding tank is enclosed and includes manhole cover for human access and fluid filling. It has a volume of at least 6 cubic meters and is adapted to transport fresh water to the oil field storage tank. The first holding tank has at least one baffle member.

In a preferred embodiment of the present invention the second and third fluid holding tanks hold at least 1.5 cubic meters of water and are mounted adjacent to the first fluid holding tank. The second and third holding tanks both include means for mixing chemicals for injection into an aqueous solution. The mixing means comprise a plurality of mixing paddles fixed radially around an axis of rotation, a motor operatively connected to the axis of rotation; and, means for controlling the speed of the motor. The motor and means for controlling the speed of the motor are hydraulic. The second and third fluid holding tanks may have open tops or they may have removable tops for protection against the weather. Each of the second and third tanks has outlets connected to a header having a header discharge that includes an isolation valve.

The chemicals that are mixed into an aqueous solution for injection into the slurry comprise a flocculating agent, a coagulating agent; and, a surfactant. In a preferred embodiment of the invention the flocculating agent is CIBA®ZETAG®7587; the coagulating agent is CIBA®ZETAG®338; and, the surfactant is Baker Hughes® R E 4742 FLW. The aqueous solution comprises: 1.5 cubic meters of water; 0.5 liters of CIBA®ZETAG®7587; 0.5 liters of CIBA®ZETAG®338; and, 0.5 liters of Baker Hughes® R E 4742 FLW.

In a preferred embodiment of the invention, there is provided means for injecting high pressure water into the body of accumulated sand in the oil field storage tank to create the slurry. The high pressure injection means includes a high pressure pump mounted to the truck body having a pump motor, control means, a suction end, a discharge end and a source of fresh water connected to the pump suction end. There is also a furcated conduit attached to the outlet port of the oil field storage tank having a first branch for high pressure water injection through the outlet port and into the sand, a second branch having a discharge end for slurry removal out of the outlet port, and a chemical injection port within the second branch. To inject the high pressure water into the sand body there is provided a rigid rod-like conduit having a first end with a spray nozzle and a second end. The rigid rod-like conduit first end is adapted for inserted into the body of accumulated sand by way of the furcated conduit first branch. The second end of the rigid rod-like conduit second end is connected to the discharge of the high pressure pump by a first conduit having an isolation valve. The source fresh water is the first fluid holding tank wherein fresh water is transported to the site to commence the dewatering process. The high pressure pump is adapted to create water pressure of at least 300 p.s.i. at the nozzle end of the rigid conduit within the body of accumulated sand. The high pressure pump motor and pump control means are hydraulic.

In a preferred embodiment of the invention, slurry from the oil field storage tank is transported to the adjacent mobile dewatering apparatus or mobile settling tank by a vacuum pump that is mounted to the body of the mobile dewatering apparatus or mobile settling tank. In an alternative embodiment the vacuum pump may be mounted to the mobile chemical mixing and injection unit. The vacuum pump includes a pump motor, control means, a suction end and a discharge end. The vacuum pump suction is connected by a conduit to the furcated conduit second branch discharge end. The discharge of the vacuum pump is in communication with the dewatering apparatus or settling tank so that slurry within the field storage tank is pumped from the oil field storage tank to the dewatering apparatus or settling tank for separation into its constituent parts. The vacuum pump is adapted to pump at least 15 cubic meters of slurry per hour. The vacuum pump motor and control means are hydraulic.

In a preferred embodiment of the invention, there is provided means for injecting the aqueous chemical solution into the slurry prior to transporting the slurry to the dewatering apparatus or settling tank. The means comprises a chemical injection pump having a suction end and a discharge end. The suction end is in communication with the header discharge of the first and second fluid holding tanks and the discharge end is in communication with the chemical injection port on the second branch of the furcated conduit. This permits a continual flow of aqueous chemical solution from the second or third fluid holding tanks into the chemical injection port and hence the slurry as it exits the oil field storage tank. The use of a second and third holding tank in an alternating fashion ensures a continual supply of aqueous solution and a continual chemical treatment process until all the sand is removed from the oil field storage tank.

In one embodiment of the invention, the second and third fluid holding tanks are replenished using recycled water from the dewatering apparatus or settling tank. There is a medium pressure pump mounted to the unit truck body which draws water from the settling tank and pumps it into the second or third holding tanks as required. The first tank is also replenished in a similar fashion so that continuous high pressure injection can take place.

There is also a method of mixing chemicals in a mobile chemical mixing unit having a first and second mixing chamber having outlets with isolating valves and mixing means. The method is comprised of the following steps of: closing the outlet isolating valves to the tanks; filling each mixing chamber with 1.5 cubic meters of water having a temperature between 60 degrees Celsius and 80 degrees Celsius; adding the chemicals to each chamber in the following proportions: 0.5 liters of CIBA® ZETAG 7578; 0.5 liters of CIBA® ZETAG 338; and, 0.5 liters of Baker Hughes® R.E 4742 FLW; and, mixing the chemicals into an aqueous solution using mixing means.

BRIEF DESCRIPTION OF THE DRAWINGS

The invention will be more readily understood by reference to the following description, taken with the accompanying drawings, in which.

DETAILED DESCRIPTION OF THE INVENTION

My invention solves a long standing problem in the oil and gas recovery industry relating to the fast and inexpensive recovery and treatment of effluent from oil storage field tanks and separating the oil, water and sand prior to disposal or further processing such as recycling. In the dewatering process by-products are recovered that can be recycled and sold. My invention provides a mobile chemical mixing and injection unit for use with the mobile dewatering apparatus described in my co-pending patent application Ser. No. 10/694,716. Alternatively, my invention can be effectively used with a settling tank in the form of a water-tight and mobile hopper tank as illustrated herein. My invention results in the cost-effective recovery of formation oil and sand from remote oil storage field tanks and the dewatering of the same.

Figure 1:
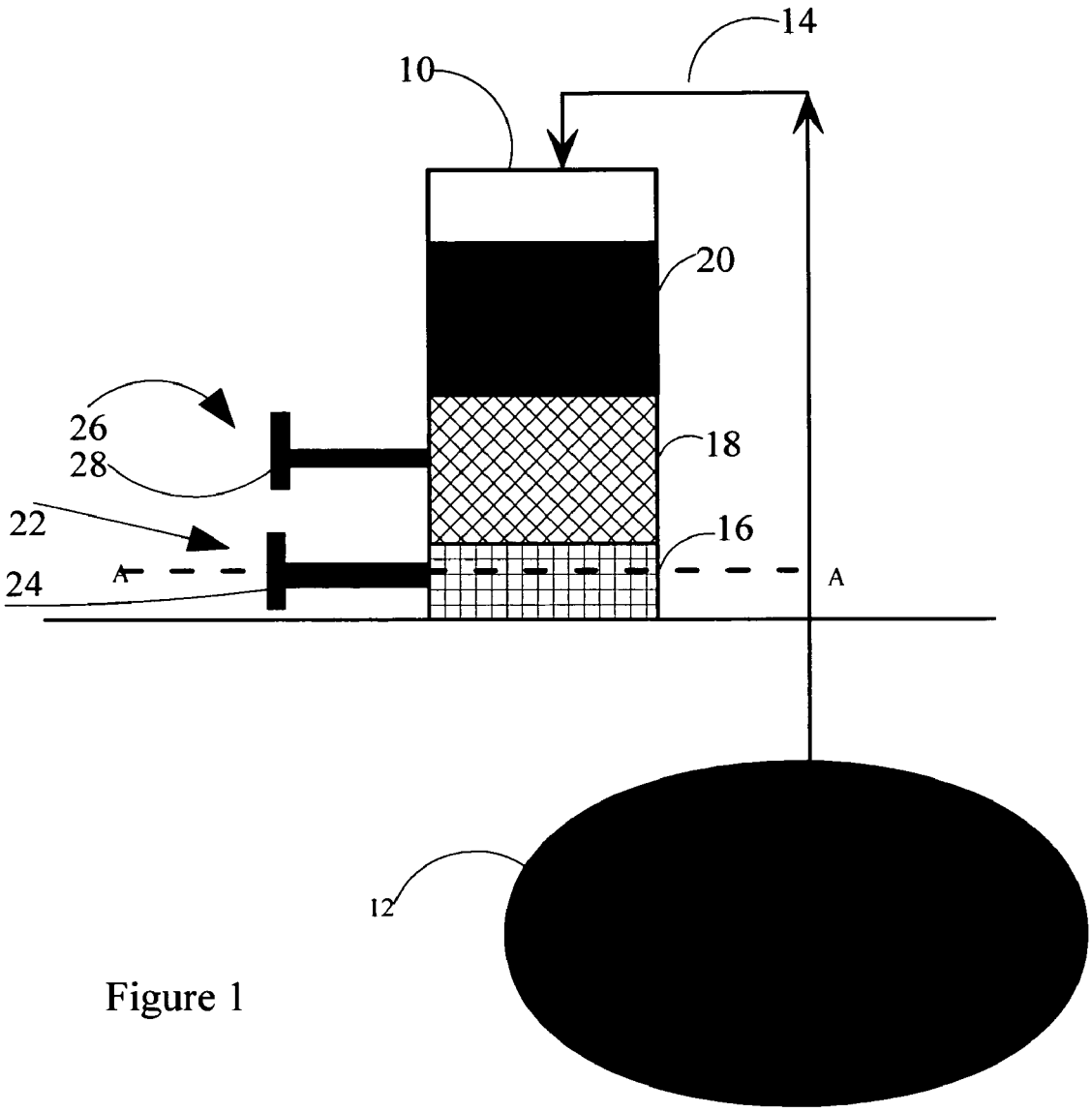
FIG. 1 is a sectional side view of a typical remote field storage tank showing the layers of formation sand, water and oil within the remote field storage tank.

FIG. 1 illustrates a typical remote field storage tank (10) found in a typical oil and gas field. A water-oil-sand mixture is pumped from the formation (12) through a conduit (14) into tank (10) for storage. After a certain period of time the water-oil-sand mixture will separate. Sands (16) will settle to the bottom of the oil field storage tank forming a body of sand. Water will separate into a layer (18) between the oil and the sand. The oil (20) will float on top of the water layer. The tank is generally equipped with a plurality of flanged fluid drain ports located in a vertical alignment on the tank so that the contents of the tank can be tapped for oil or water as desired. Shown in FIG. 1 for illustrative purposes is port (22) having flange (24) and port (26) having flange (28). The most effective manner to remove the water and sand from the remote oil storage tank is to remix the sand with the water and create a slurry that can be drawn out of the bottom of the tank.

Figure 2:
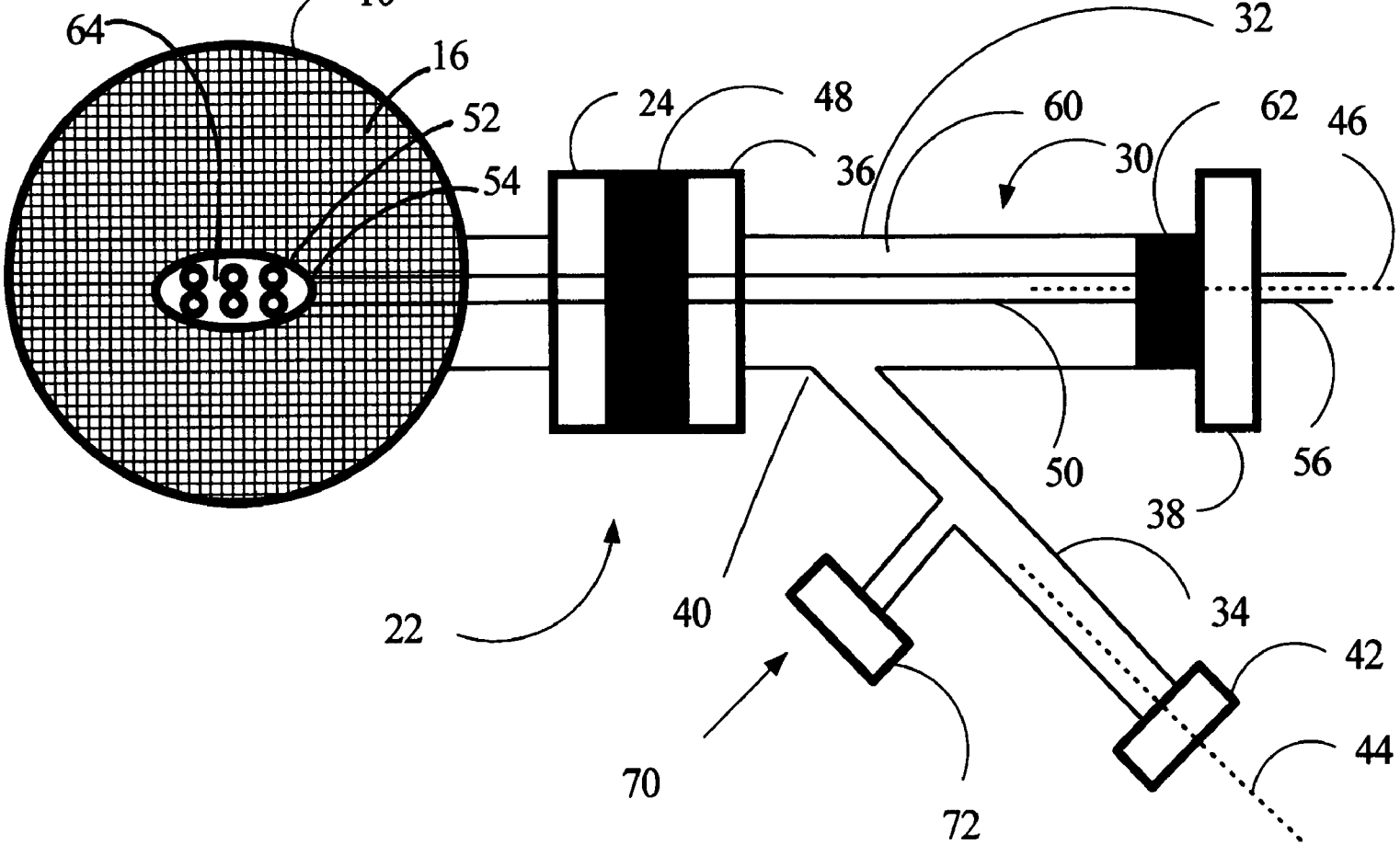
FIG. 2 is a sectional top view along A-A (FIG. 1) of the furcated conduit and high pressure injection means described in my co-pending patent application Ser. No. 10/694,716 to create slurry within the remote field storage tank and remove the slurry for further processing and chemical treatment.

Referring to FIG. 2 there is shown sectional view A-A (FIG. 1) through the sand settled in the tank (10) and along furcated conduit (30) which is adapted for connection to tank (10) fluid drain port (22) flange (24). The furcated conduit (30) has a first branch (32) and a second branch (34). The first branch has a flanged first end (36) and a flanged second end (38). The second branch (34) has a first end (40) connected to the first branch and a second branch flanged second end (42). The axis (44) of the second branch (34) is angled away from the axis (46) of the first branch (32) forming an inter-axial angle of less than ninety degrees. The flanged first end (36) of the first branch (32) is connected by flange (36) and flange (24) to the tank flanged fluid drain port (22). A seal (48) is inserted between flanges (36) and (24) to ensure a leak free operation. FIG. 2 is not shown to scale. The first and second branches have a diameter equal to the diameter of the tank flanged fluid drain port (22).

Also shown in FIG. 2 is high pressure water injection pipe (50) and spray nozzle (52) for injecting high pressure water into the formation sand (16) within the tank (10) through the first branch (32) of the furcated conduit in order to create a sand-water slurry within the tank. This process is described in my co-pending U.S. patent application Ser. No. 10/694,716 incorporated herein by reference.

The slurry is withdrawn from the storage tank by way of the second branch (34) of the furcated conduit and then transported by a conduit to the mobile settling tank located next to the tank.

Still referring to FIG. 2, there is shown the high pressure rigid rod-like water injection pipe (50) for injecting high pressure water into the formation sand (16) within the tank (10) through the first branch (32) of the furcated conduit (30) in order to create the sand-water slurry. Pipe (50) has a pipe first end (54) and a pipe second end (56) and a length adequate to transverse the length of the furcated conduit plus the radius of the tank so that the pipe first end is proximate to the centre of tank (10). The pipe second end (56) extends from the first branch flanged second end (38). The act of inserting the pipe into the first branch flanged second end creates an annulus (60) within the first branch. The annulus is sufficiently dimensioned to permit an adequate flow of sand-water slurry from the tank and into the second branch of the furcated conduit. The annulus at the first branch flanged second end is sealed by suitable a seal (62) to prevent leakage of sand-water slurry.

Nozzle (52) is attached to the pipe (50) first end (54). The nozzle is perforated (64) to create a spherical spray pattern of high pressure water within the formation sand. In one embodiment of my invention the nozzle has seven (7) holes and each hole is 1/16 inches in diameter. The spherical spray pattern is adapted to mix the formation sand and water within the tank to create the sand-water slurry without causing the oil stored within the tank to substantially mix with the sand-water slurry.

There is also provided a flanged chemical injection port (70) having flange (72) adapted for connection to the mobile chemical mixing and injection apparatus as more fully described below.

Figure 3:
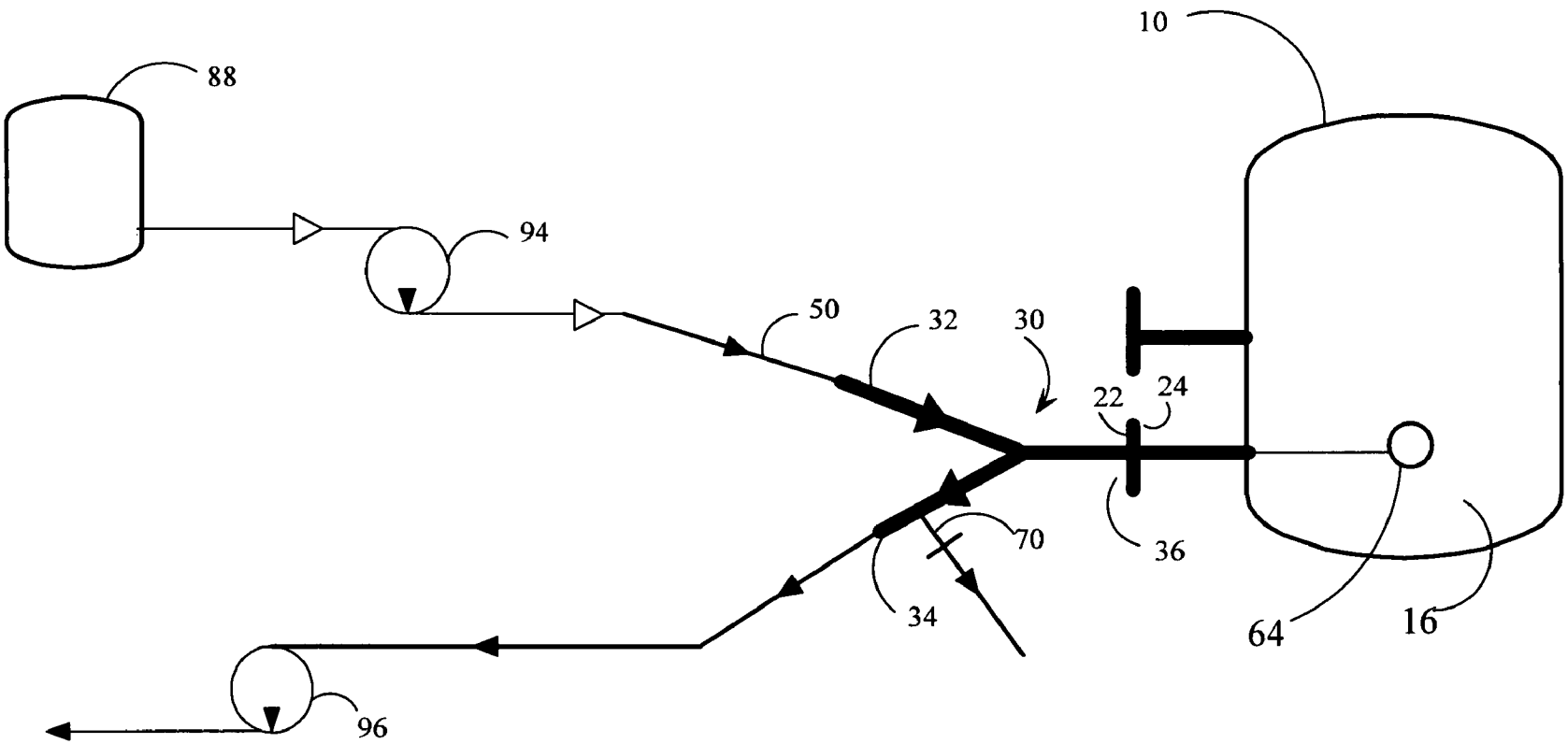
FIG. 3 is a schematic diagram showing the apparatus and method of creating a slurry.

Referring to FIG. 3, there is shown a simple schematic diagram of the apparatus used to remove slurry from the oil field storage tank (10). Furcated conduit (30) is shown connected to port (22) at flange connection (24) and (36). High pressure water is injected into the tank from a water source (88) by high pressure pump (94) via the injection pipe (50) inserted into the first branch (32) of the bifurcated conduit (30). The high pressure water is injected into the sand contained in the oil field storage tank (10) by way of nozzle (64). The slurry that is created with the sand (16) and high pressure water is drawn from the tank by way of the second branch (34) of the bifurcated conduit (30). Vacuum pump (231) provides the motive force to draw the slurry from the tank. The slurry is then pumped to a mobile settlement tank hopper where the oil, sand and water settle into lawyers. In this embodiment of the invention, the hopper does not possess the screen features described in my co-pending patent application Ser. No. 10/694,716 incorporated herein by reference. As an alternative, the dewatering apparatus of my co-pending invention may be used.

Chemical addition to the effluent stream is by way of flanged injection port (70). It is at this point that the subject matter of the present patent application is described, namely, a mobile chemical mixing unit.

Figure 4:
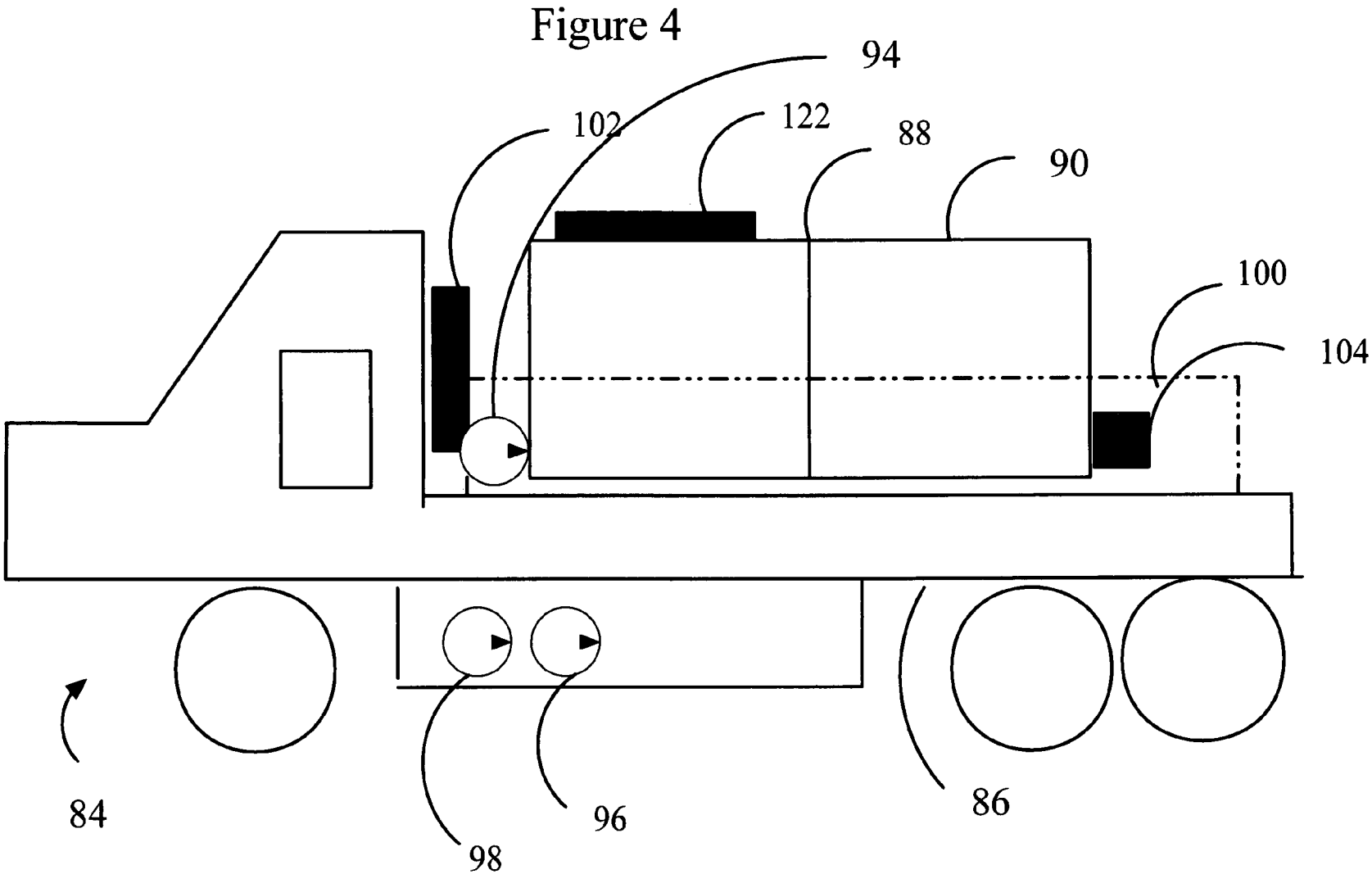
FIG. 4 is a side view of one embodiment of the mobile chemical mixing unit.

Referring now to FIG. 4, there is illustrated the mobile chemical mixing unit (82) of one embodiment of my invention. The unit comprises a truck (84) having a flat bed (86). The mixing unit tanks are shown mounted on the bed of the truck. In another embodiment of the invention, the unit can be mounted to a flat bed trailer and towed to the dewatering site. The mobile chemical mixing unit further comprises a first water tank (88) adapted for storing about 6 cubic meters of water. The water is obtained on-site, that is at the oil field storage tank location or it may be transported to the site in the tank (88). The water obtained on site is heated to between 60 degrees Celsius and 80 degrees Celsius. A person skilled in the art will know that heating means are provided with remote field storage tanks in order to prevent the oil, water and sand within the tank from freezing during colder months. Also mounted to the bed (86) of the truck (84) are mixing tanks (90) and (92) used to mix the chemicals for injection into the effluent slurry from the oil field storage tank. The invention further comprises a truck mounted high pressure pump (94) adapted to inject high pressure water from a source of clean water into injection pipe (50) in order to create the slurry within the tank. The high pressure pump is exemplified by the Hydra-Gell™ pump having a maximum flow rate of 35 to 37 gallons per minute having a maximum inlet pressure of 250 psi and a maximum outlet pressure of 1200 psi. Pump (94) generates 300 psi of pressure at the discharge nozzle (52) shown in FIG. 1. Initially the source of water for high pressure injection is provided by tank (88) but as the dewatering process continues, recycled water from the dewatering apparatus or settlement tank hopper may be used for high pressure water injection as more fully explained below. A spare vacuum pump (98) is mounted to the truck body and is used to draw slurry from the oil field storage tank and transport it into the adjacent dewatering apparatus or settlement tank hopper. The vacuum pump (98) and (231) are typically centrifugal pumps exemplified by the MAGNUM 1™ pump manufactured by Mission. This pump is capable of moving up to 15 cubic meters of slurry per hour. A medium pressure pump (96) is mounted to the truck bed and is used to pump water from an alternative source of clean water by conduit (181) to the tanks (88), (90) and (92) through conduit (184) and valve (186). Pump (96) is generally capable of a maximum pressure of 100 psi and is able to pump 232 gallons per minute at 10 psi.

Dotted line (100) represents a safety fence around the truck bed. Pumps (94), (96) and (98) are hydraulically operated and so block (102) represents a hydraulic fluid reservoir for the operation of all the pumps. Block (104) represents the hydraulic control station for the operator. The pumps of the invention are all hydraulically motivated and controlled. In the alternative, the pumps can be electrically operated or they can be pneumatically operated. Similarly, all the valves associated with the invention are either gate valves or ball valves and are manually operated, electrically operated or pneumatically operated.

Figure 5:
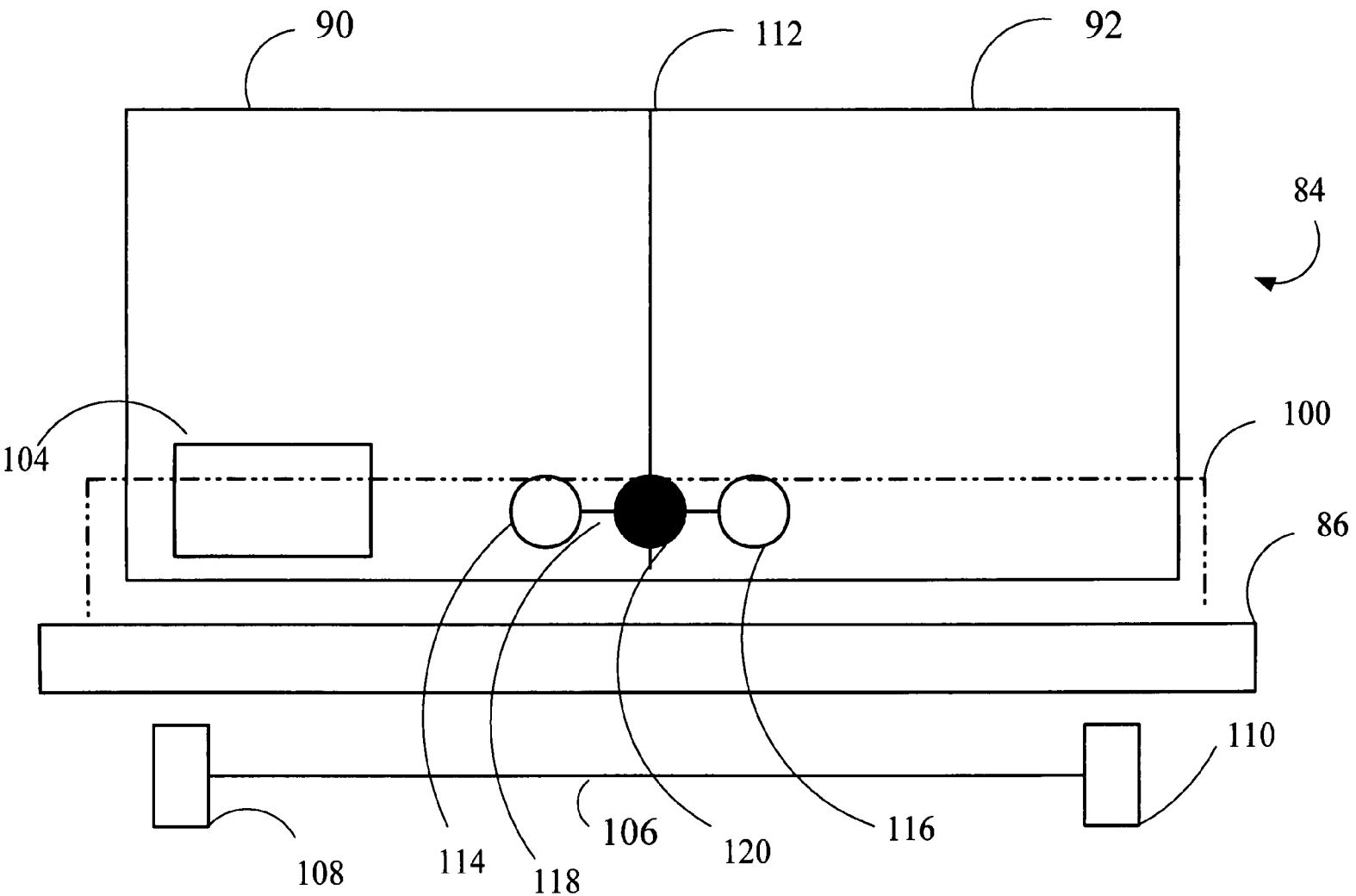
FIG. 5 is a rear view of one embodiment of the mobile chemical mixing unit.

Referring now to FIG. 5, there is shown a rear view of the truck (84) illustrating mixing tanks (90) and (92) mounted to truck bed (86). Truck rear axle (106) and wheels (108) and (110) are also illustrated. Tanks (90) and (92) are adjacent to each other and share a common wall (112). Control station (104) is illustrated as is safety fence (100). Tank (90) has an outlet (114) and tank (92) has an outlet (116). These outlets are connected by a header pipe (118) having an outlet (120).

Figure 6:
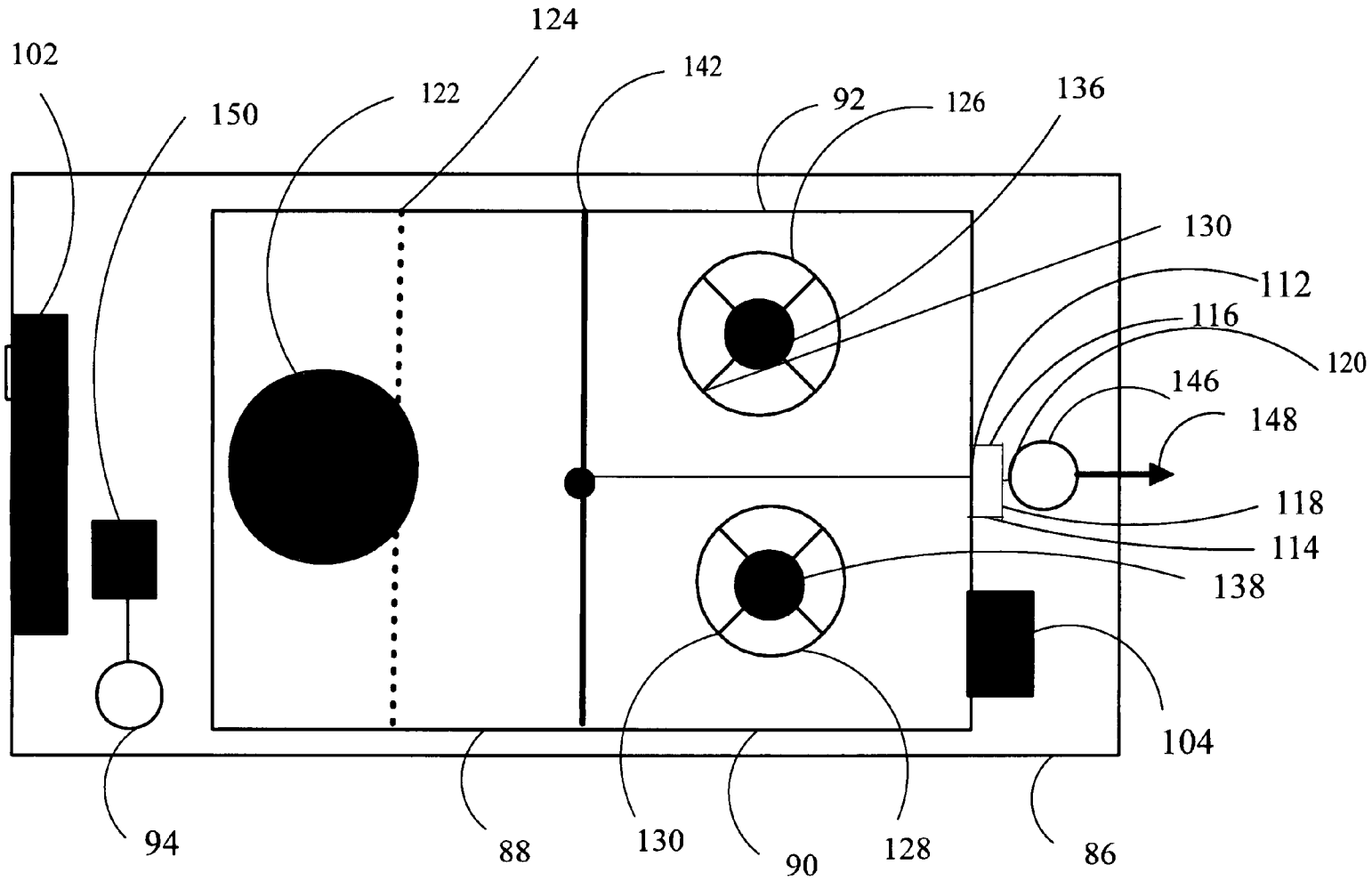
FIG. 6 is a top view of one embodiment of the mobile chemical mixing unit.

Now referring to FIG. 6, there is shown a top view of the invention mounted to truck bed (86) comprising water storage tank (88) having manhole (122) and an interior baffle (124). Mixing tanks (90) and (92) include mixing means (126) and (128) adapted to mix chemicals added into the mixing tanks. In this embodiment, the mixing means comprise a plurality of rotating paddles (130) that are counter-rotated. The paddles are driven by hydraulic motors (136) and (138). These motors can also be electric motors. The mixing tanks share a common wall (112) with each other and a common wall (142) with water storage tank (88). Mixing tank (90) has outlet (114) and mixing tank (92) has outlet (116). Outlets (114) and (116) are connected by header (118) having outlet (120). The mixing tanks are open to the atmosphere in one embodiment but they may also be fitted with coverings to protect the contents from the weather.

The suction end of chemical injection pump (146) is attached to the outlet (120). The discharge end (148) of pump (146) is attached by way of a conduit to the chemical injection inlet port (70) on the second branch (34) of furcated conduit (30). Also shown in FIG. 6 is the operator control station (104) and hydraulic reservoir (102). Pump (94) is shown as well as its hydraulic driving motor (150).

Figure 7:
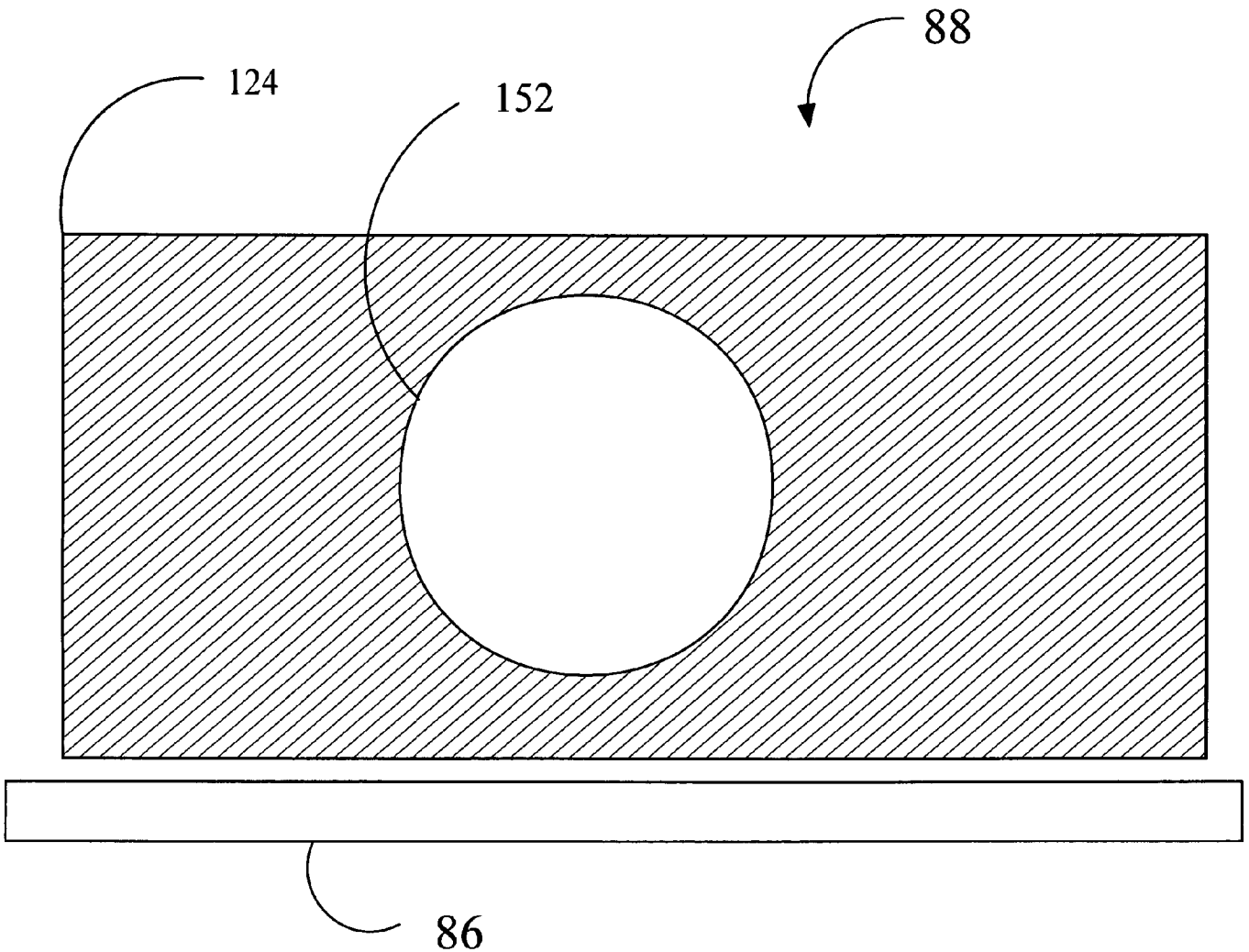
FIG. 7 is a sectional view of one embodiment of the mobile chemical mixing unit showing the internal baffle.

Referring to FIG. 7, there is shown a cross-section of the water storage tank (88) mounted to truck bed (86) illustrating the interior baffle comprising a plate (124) fixed across the centre of the water tank and including an orifice (152). The baffle is adapted to prevent excessive movement of water within the tank.

The hydraulic circuits used to connect and control the operation of the various hydraulic motor driven pumps are neither illustrated nor described in this patent application. A person skilled in the art of hydraulic driven motors would understand the well known manner in which to install these motors and pumps, hydraulic fluid reservoirs and conduits and hydraulic circuit control means and they need not be further described in this application.

Figure 8:
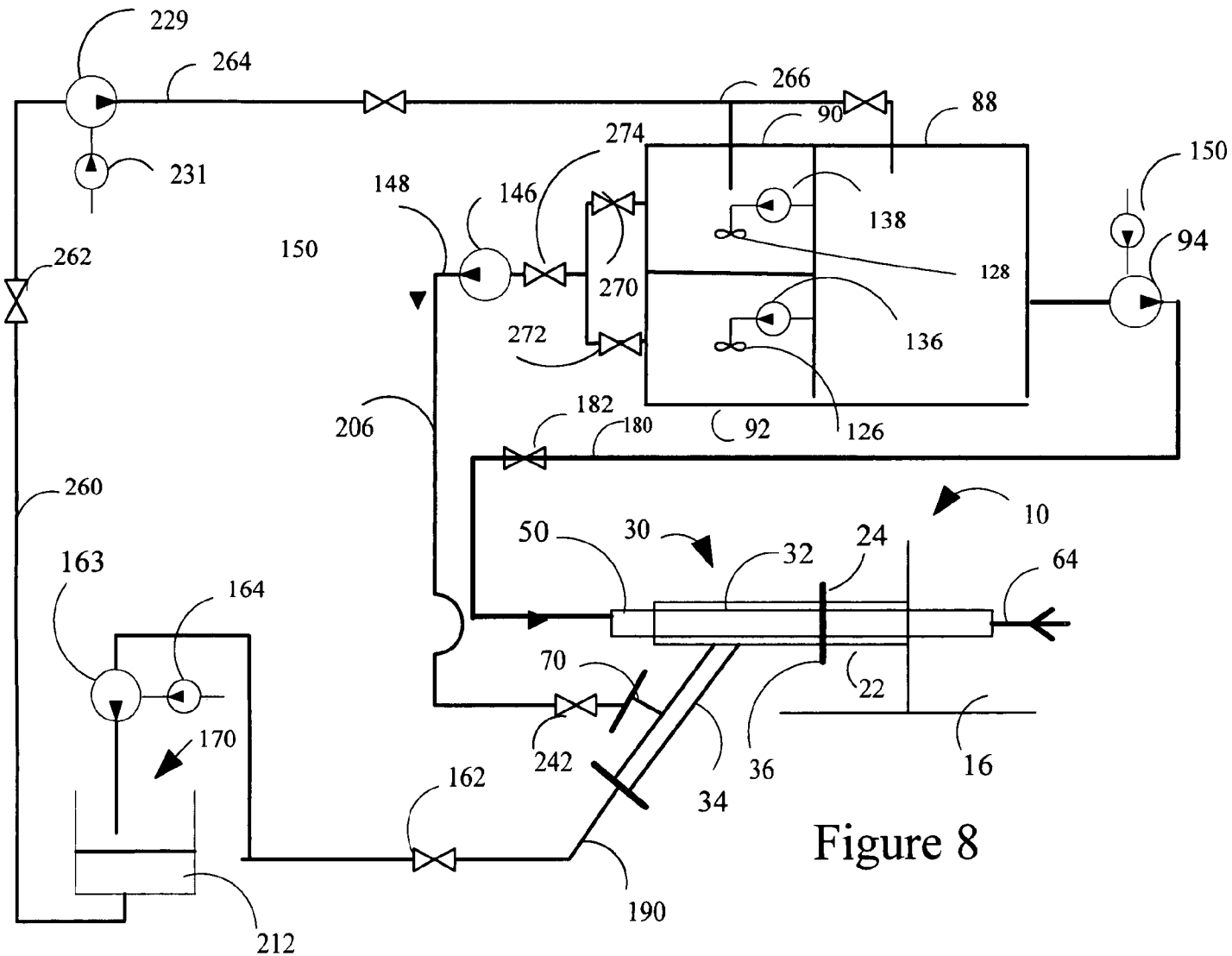
FIG. 8 is a schematic diagram showing one embodiment of the invention showing the basic flow of materials between the field tank, the mobile chemical mixing unit and a settling tank.

Referring now to FIG. 8, there is shown a schematic diagram of the invention in operation. Field tank (10) is illustrated with outlet port (22) and flange connection (24) to flange (36) of the furcated conduit (30). High pressure pump (94) and motor (150) mounted to truck bed (86) has suction end connected to a source of fresh water (88). The source of water is from tank (88) that is replenished by recycled water from the settling tank hopper (170) as more fully described below. Discharge of pump (94) is into first conduit (180) throttled by valve (182) and feeds into injection pipe (50) terminating at nozzle (64) within the sand (16). As previously described injection pipe traverses the first branch (32) of the furcated conduit (30). The second branch (34) of the furcated conduit (30) discharges the slurry effluent from the tank (10) through conduit (190) and valve (162) and into the settling tank hopper (170). Vacuum pump (163) and motor (164) are mounted to the settling tank hopper. Alternatively, a second vacuum pump can be mounted underneath the truck (84) as a redundant vacuum pump (96). The vacuum pump draws the effluent from the tank (10) and discharges the effluent directly into the settling tank hopper (170) shown schematically in FIG. 8 and illustrated in FIG. 9. Clarified water (212) is pumped by pump (229) (identical to pump (98)) from the settling tank hopper (170) is pumped back to tanks (88), (90) and (92) by way of conduits (260) and (264). This fluid pathway terminates in flex hose (266) which is capable of alternatively addressing and filling tanks (88), (90) and (92). Shown in tank (90) is agitator (128) with motor (138) and shown in tank (92) is agitator (126) with motor (136). Fresh water reservoir tank (88) is also shown and is used as a source of clean water for initial high pressure injection into the field storage tank (10).

FIGS. 9 to 13 inclusive describe the relationship between the mobile chemical mixing unit, the settling hopper tank and the field tank and show the relevant interconnections. Although the interconnections are not complicated, describing them with reference to a single drawing is difficult and so portions of the connections are described with reference to subsequent diagrams.

Figure 9:
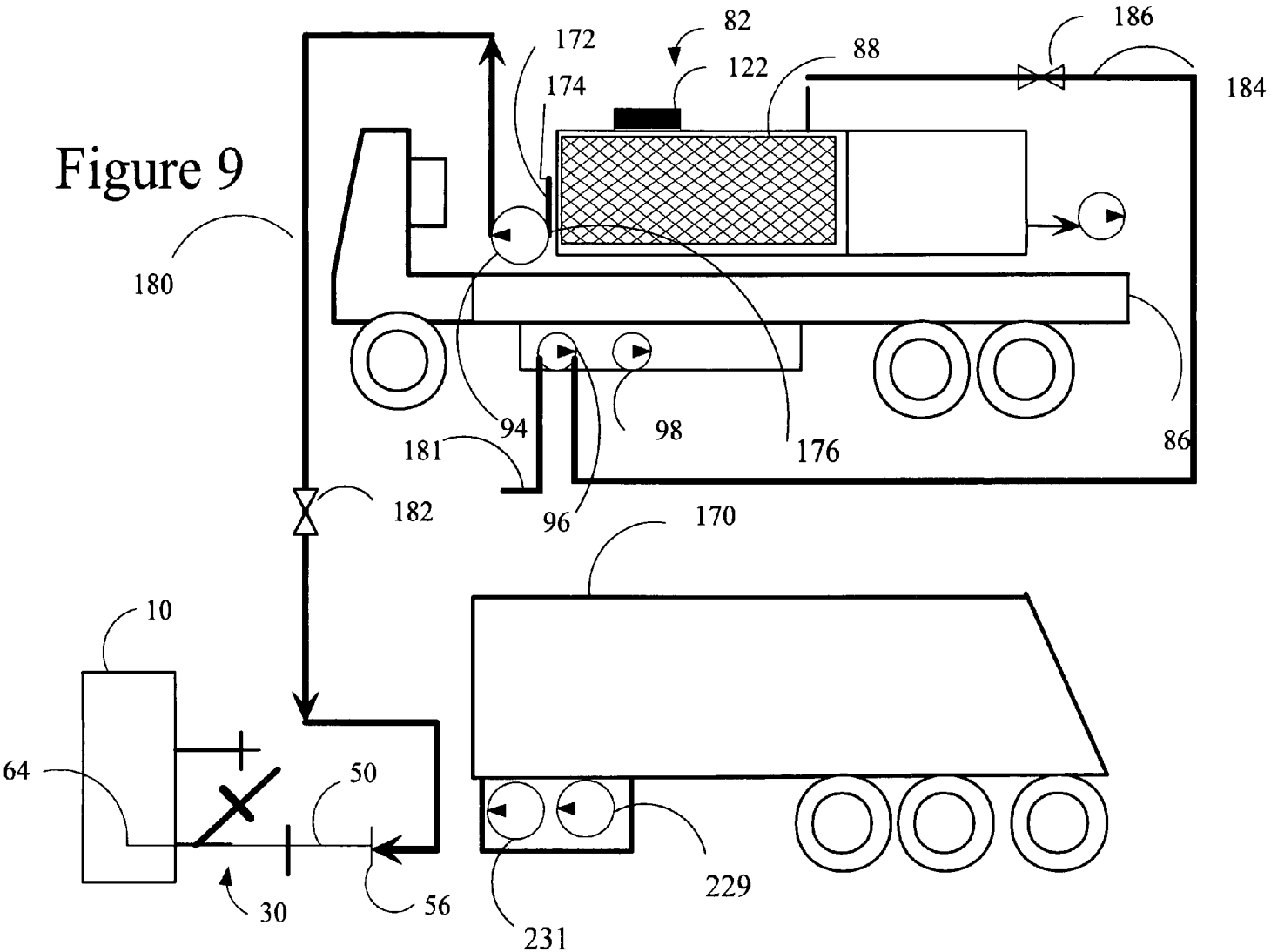
FIG. 9 is a schematic view of one embodiment of the invention showing high pressure water flow of the invention.

Referring now to FIG. 9, there is shown a schematic diagram of the mobile chemical mixing unit (82), the field tank (10) and the settling tank hopper (170). The vehicles would be stationed in close proximity to the field storage tank to facilitate the hook-ups. The number of pumps mounted to the hopper may vary. In this embodiment of operation two are shown for the purposes of this description, vacuum pump (163) and motor (164) and medium pressure pump (229) and motor (231) but more may be mounted. Mounted to flat bed (86) is fresh water tank (88) shown filled in FIG. 9 with manhole (122). Conduit (172) is connected from the fresh water tank outlet (174) to the intake (176) of pump (94). Pump (94) is a high pressure pump exemplified by the Hydra-Gell™ pump having a maximum flow rate of 35 to 37 gallons per minute having a maximum inlet pressure of 250 psi and a maximum outlet pressure of 1200 psi. Pump (94) generates 300 psi of pressure at the discharge nozzle (64) within the field storage tank (10). It is has been shown that this discharge pressure is adequate to create a slurry within the field storage tank. The discharge end of the pump (94) is connected to conduit (180) which may be steel tubing or a suitable flexible connector. Discharge from pump (94) is controlled by valve (182). Conduit (180) terminates at and is connected to the second end (56) of the pipe (50) inserted into the field storage tank (10) through furcated conduit (30).

Figure 10:
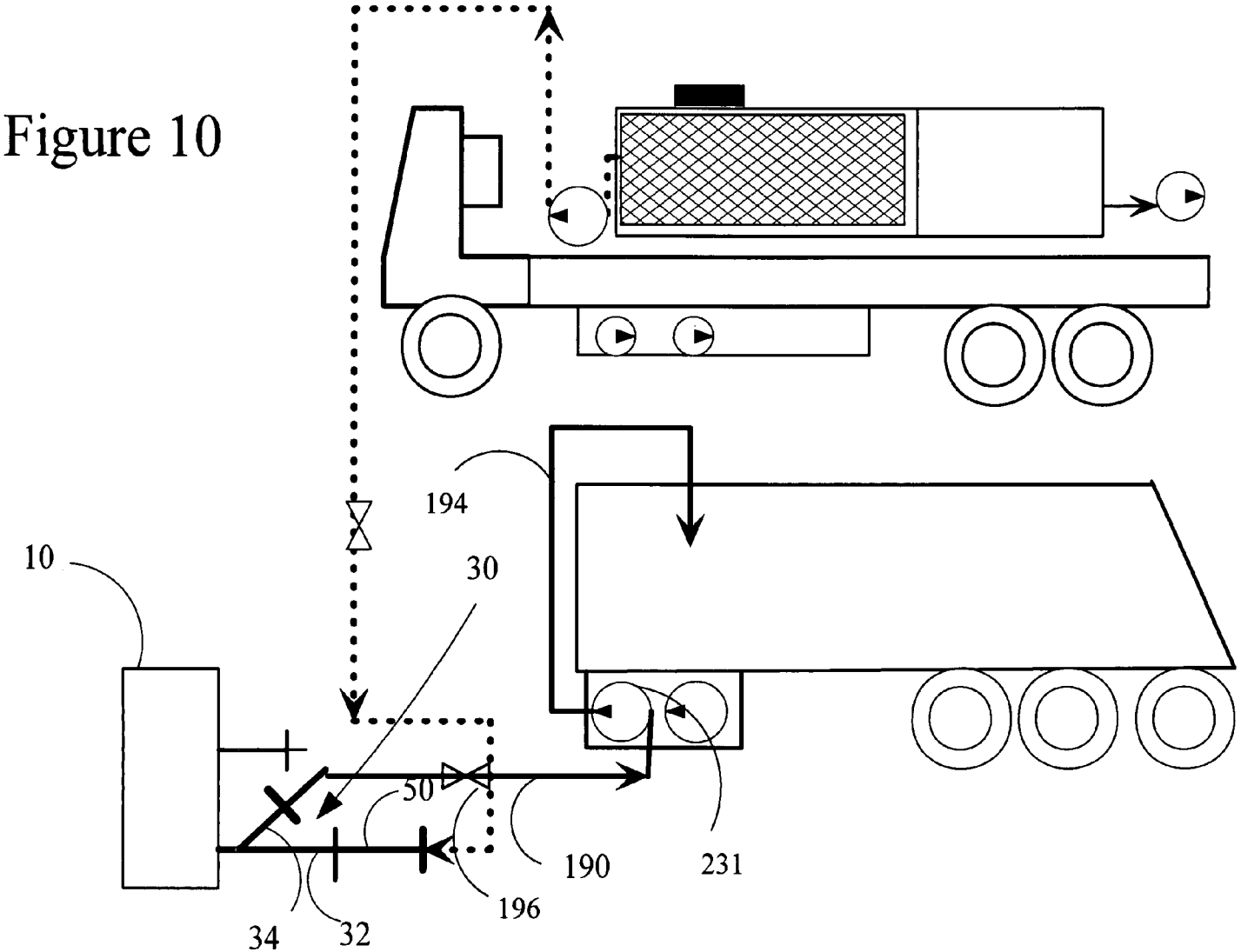
FIG. 10 is a schematic of one embodiment of the invention showing flow of slurry from the oil field storage tank to the settling tank.

Referring now to FIG. 10, there is shown a drawing of the pathway of the slurry pumped from the field storage tank (10) to the settlement hopper tank (170). The previously described connections are shown in dotted line format. Once the high pressure water is injected into the field storage tank by way of the first branch (32) and pipe (50) and the slurry created, the slurry is pumped from the field storage tank to the settlement hopper tank by way of the second branch (34) of the bifurcated member (30). Second conduit (190) transports the slurry from the outlet of the second branch to the intake of slurry vacuum pump (231). The flow of slurry can be isolated by way of valve (196). The slurry is then directly discharged into the settlement tank hopper (170) by way of discharge third conduit (194). The slurry vacuum pump (231) is exemplified by a centrifugal pump by such as the MAGNUM 1™ pump manufactured by Mission. This pump is capable of moving up to 15 cubic meters of slurry per hour.

Figure 11:
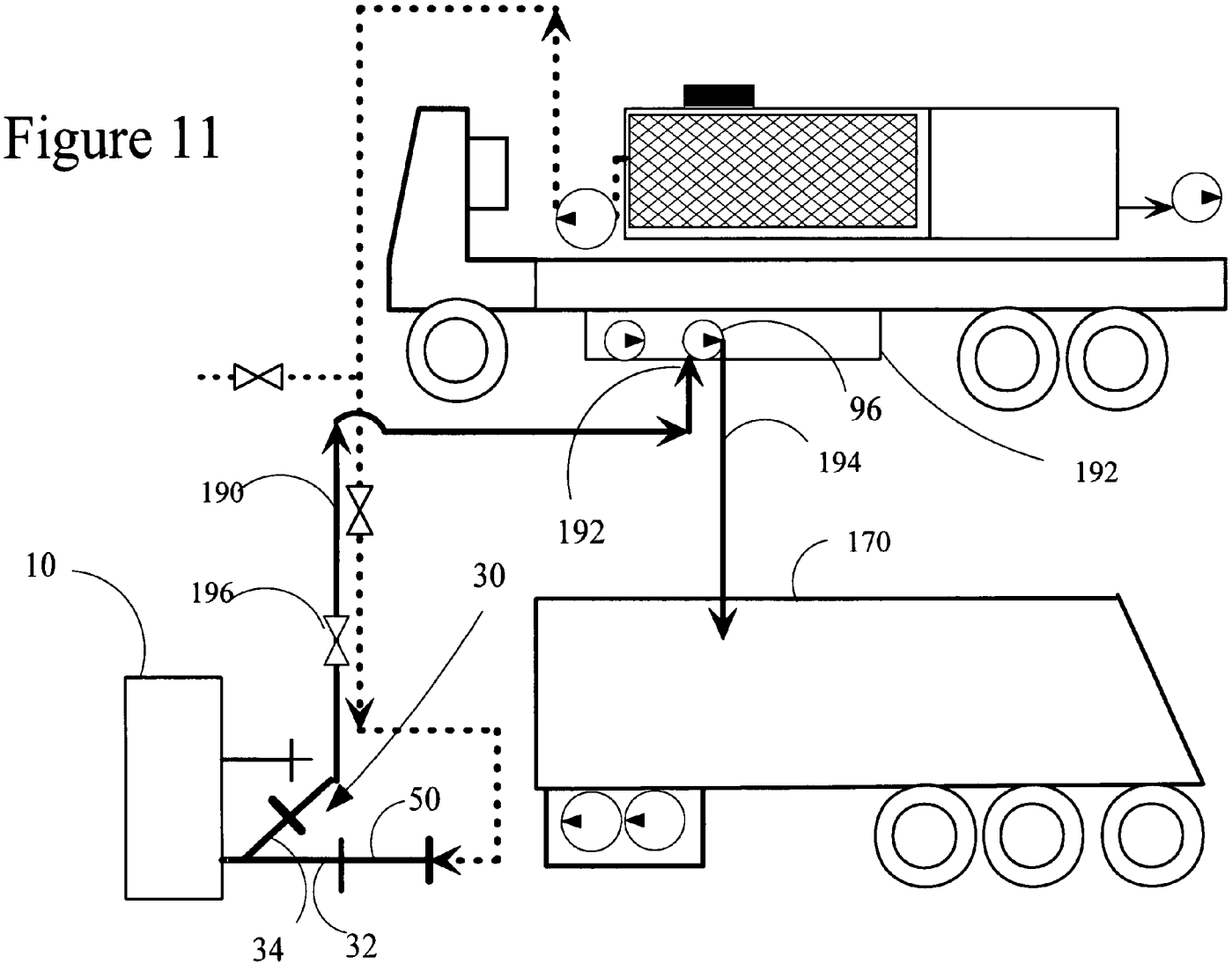
FIG. 11 is a schematic of an alternate embodiment of the invention showing flow of slurry from the oil field storage tank to the settling tank.

FIG. 11 illustrates an alternate pathway for the slurry when redundant pump (96) mounted to the truck body is employed.

Figure 12:
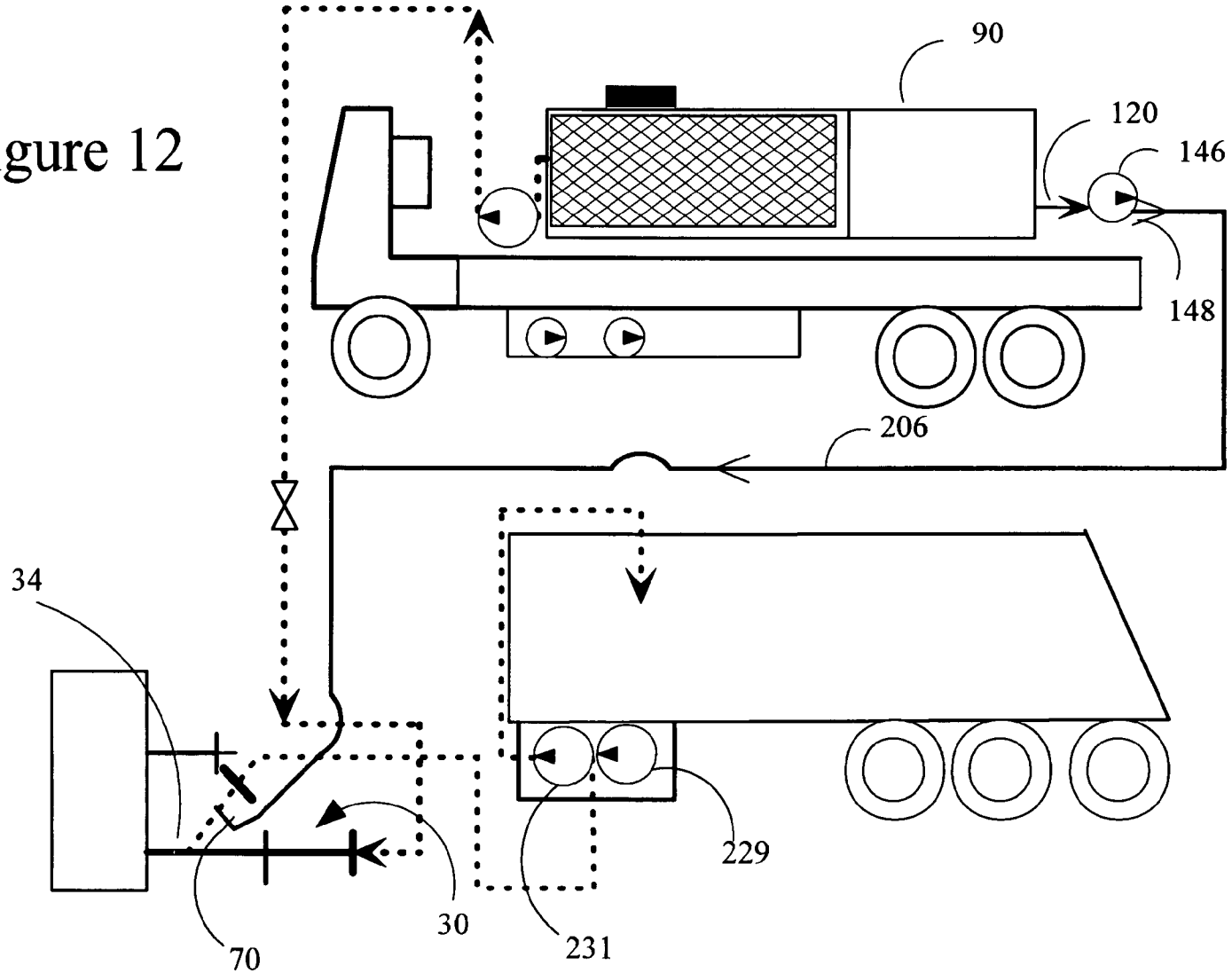
FIG. 12 is a schematic of one embodiment of the invention showing chemical injection flow from the mobile chemical mixing unit into the chemical injection port on the furcated conduit.

Referring now to FIG. 12, there is shown the pathway of chemical injection from the mobile chemical mixing unit to the field storage tank. The outlet of tank (90) and (92) are connected to header (118) discharge (120) which is in turn connected to the intake of chemical injection pump (202). The discharge (204) of the injection pump (202) is connected to conduit (206) with travels from the chemical mixing tank to the chemical addition intake port (70) located on the second branch (34) of the furcated conduit (30). In this way the chemicals are added to the slurry as it is discharged from the oil field storage tank (10) and before it is transported to hopper (170). The chemical injection pump is a low volume pump capable of pumping an effective volume of aqueous chemical mixture into the intake port (70). Conduit (206) is typically a flexible member such as a reinforced TYGON® hose.

Figure 13:
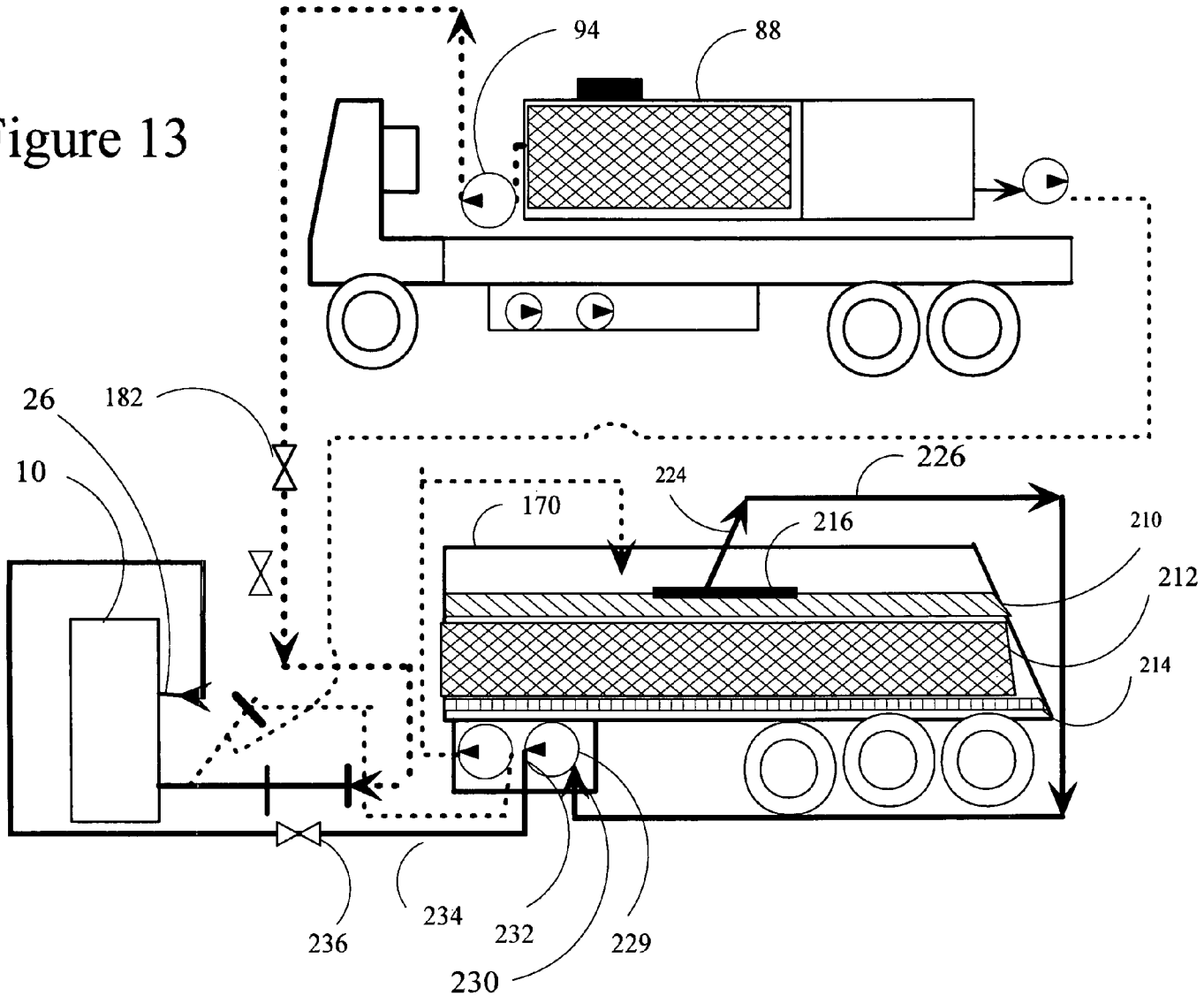
FIG. 13 is a schematic of one embodiment of the invention showing the flow of recovered oil from the settling tank to the field oil storage tank.

Referring now to FIG. 13, there is shown the hopper (170) and the various layers of oil (210), water (212) and sand (214) separated therein. An operator operates an oil skimming vacuum device represented by block (216) to skim and draw the floating oil from the surface of the water (212). The vacuum device is attached by way of a flexible hose (224) to a suction conduit (226) and suction pump (229) intake (230). Suction pump discharge (232) is connected to conduit (234) which transports the recovered oil back to the oil storage tank (10) and inlet port (26). Valve (236) controls and isolates the flow of oil as necessary. In this manner, recovered oil is transported back to the tank where is will float on top of the slurry. With chemical addition all of the oil is recovered during the sand dewatering process and returned to the oil storage tank.

Figure 14:
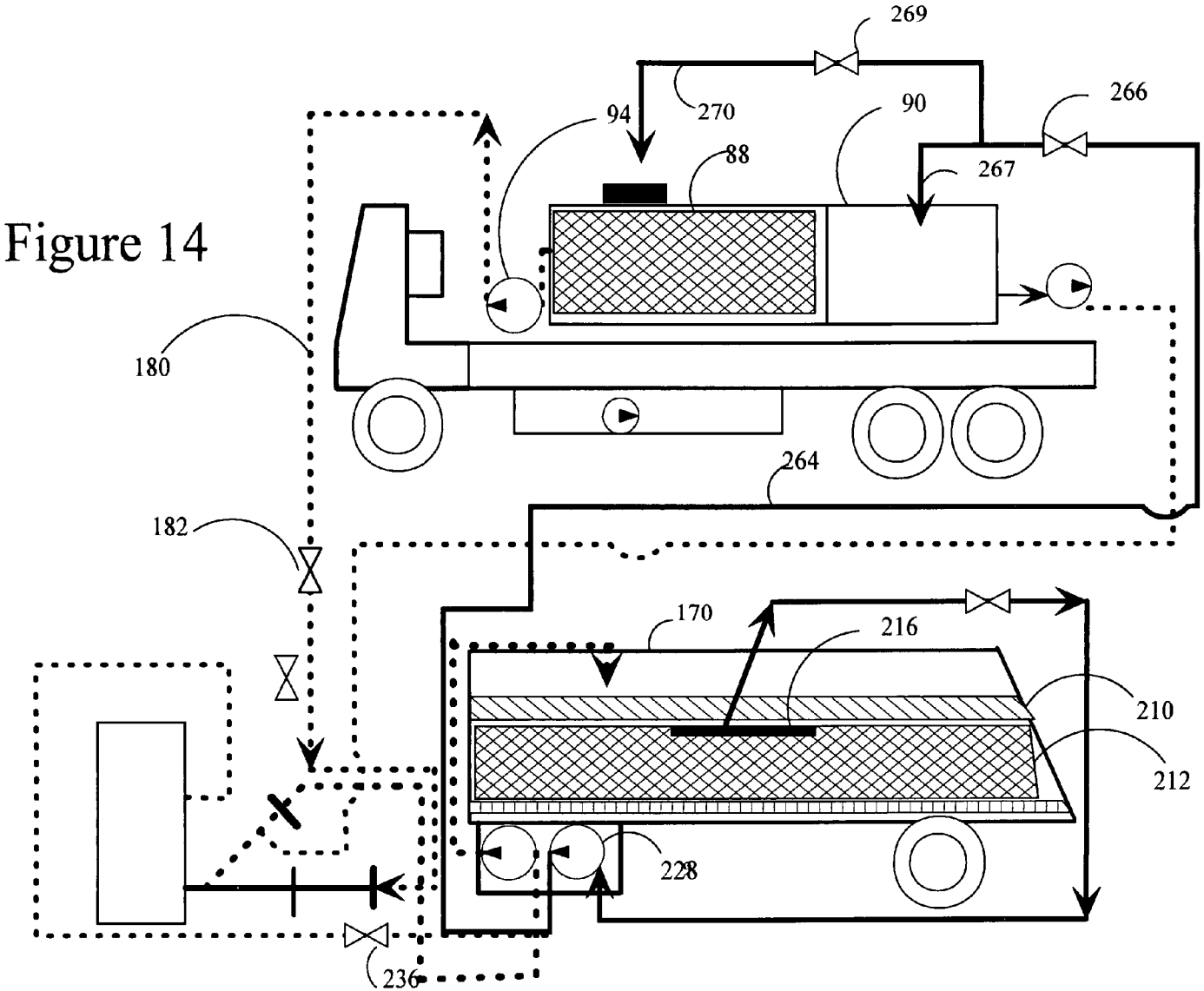
FIG. 14 is a schematic view of one embodiment of the manner in which water removed from the slurry in the settling tank is recycled to the mobile chemical mixing unit and is also used as high pressure feed water.

Referring now to FIG. 14, there is shown the manner in which recycled water from the hopper (170) is used as high pressure injection water and as water to replenish the chemical mixing tanks. The chemical mixing tanks (90) and (92) are empty when the unit (84) arrives at the site. It is only through the dewatering process that the mixing tanks have a source of water. Therefore, chemical addition does not begin until the dewatering process is sufficiently advanced to fill the mixing tanks. Furthermore it is obvious that the initial volume of water in unit tank (88) is not sufficient to maintain the dewatering process although there is sufficient water in that tank to commence the process. The hopper will soon fill with slurry from the tank (10). The slurry will separate into its constituents of oil (on the surface), water and sand. To refill injection water tank (88) to maintain high pressure injection into the field tank (10) an operator at the hopper closes valve (236) to the field storage tank and the operator on the mixing unit opens valves (266) and (269). The operator on the hopper pushes the skimmer (216) through the oil layer (210) into the water layer (212). Hence, pump (229) will be drawing water from the hopper and discharging it into the injection water storage tank (88) by way of fifth conduit (264) and sixth conduit (270). Similarly, to fill the mixing tanks, the discharge of pump (229) is directed to tanks (90) and (92) by way of conduit (264), flexible discharge hose (267) and opened valve (266). Valve (269) will be closed. Discharge hose (266) permits the filling of tanks (90) and (92) alternatively.

Now that the various connections and relationships have been described as between the oil field storage tank, the mobile chemical mixing unit and the dewatering apparatus, the chemical addition can now be described.

It is well known in the art that the addition of chemicals to a slurry such as the one described above, enhances oil-water-sand separation. However, I have found through experimentation and experience that adding chemical agents in the proportions described below, and not according to manufacturers specifications, to the dewatering process described in this patent application provides for total recovery of oil from the water and sand mixture.

When mixing the chemicals for injection into the field tank, the following amounts are used per mixing tank of 1.5 cubic meters in volume:

one half liter of CIBA® ZETAG 7578; plus,
one half liter of CIBA® ZETAG 338; plus,
one half liter of Baker Hughes® R.E 4742.

To ensure optimal effectiveness of the chemical addition the temperature of the fluids in the mixing tanks is maintained between 60 degrees Celsius and 80 degrees Celsius. This is the temperature of the mixture stored in the oil field storage tank.

Referring back to FIG. 8, the operator will add the chemicals in the proportions noted above to a first tank (90) and then to a second tank (92). The chemicals are mixed with the volume of water returned from the hopper (170) using agitators (126) and (128). When the chemicals are mixed, the chemical mixture is discharged alternatively through discharge valve (270) or discharge valve (272) and into the pump suction (120) of pump (146). The pump may be isolated from the tanks by way of isolation valve (274). The discharge of the chemical mixture from pump discharge (240) is throttled using control valve (242) so that an effective amount of chemical mixture is added to the effluent stream from the tank (10). The chemical mixture is pumped into the effluent stream by way of chemical addition port (70). In this way the dewatering process is a continual and uninterrupted process until all of the sand is removed from the oil field storage tank and all of the recovered oil is returned thereto.

The method of the connecting the mobile chemical mixing and injection unit to the settlement tank hopper can be described as follows:

connecting the high pressure injection conduit (180) between the high pressure injection pump (94) and high pressure injection pipe (50);

connecting the slurry discharge conduit (190) between the discharge port of the second branch (34) of the furcated conduit (30) and the intake of the vacuum pump (231);

connecting chemical injection conduit (206) between the discharge of the chemical injection pump (146) and the chemical injection port (70) in the second branch (34) of furcated conduit (30);

connecting oil skimmer (216) conduit (226) to intake (230) of pump (229);

connecting the discharge of pump (229) to oil field storage tank (10) intake port (26);

starting pump (94) and pump (231) to commence slurry formation, pumping of slurry to the hopper (170) and stratification of the oil, sand, water mixture;

waiting for hopper tank (170) to fill and then valving in pump (229) to fill the mixing tanks (90) and (92);

ensuring the water temperature is between 60 Celsius and 80 Celsius;

filling the mixing tanks and then adding chemicals in accordance with the following formulation per 1.5 cubic meters of mixing tank:

0.5 liters Ciba Zetag 7587;

0.5 liters Ciba Zetag 338;

0.5 liters Baker Hughes R E 4742;

continuously pumping the chemical mixture from each tank to the inlet port (70) at an effective rate; and, maintaining fluid flow through all components until all sand is removed from tank (10) and all oil is recovered and returned to tank (10).

Although the description above contains many specifications, these should not be construed as limiting the scope of the invention but as merely providing illustrations of some of the presently preferred embodiments of this invention. Thus the scope of the invention should be determined by the appended claims and their legal equivalents rather than by the examples given.

What is claimed is:

1. A mobile chemical mixing and injection unit adapted for use during the extraction of an oil/water/sand slurry from an oil field storage tank wherein said tank has a body of accumulated sand therein, an outlet port and an inlet port, and wherein said unit comprises:

a. a mobile platform comprising a motorized truck body having a flat bed;

b. a first fluid holding tank for holding a first volume of fresh water, a second fluid holding tank for holding a second volume of fresh water and mixing a first group of flocculants, coagulants and surfactants in said second volume of fresh water thereby forming a first aqueous chemical solution; and, a third fluid holding tank of equal size to said second fluid holding tank for holding a third volume of fresh water and mixing a second group of flocculants, coagulants and surfactants in said third volume of fresh water thereby forming a second aqueous chemical solution; wherein said first fluid tank is mounted to said flat bed, and wherein said second and third fluid holding tanks are mounted to the flat bed adjacent to the first fluid holding tank in tandem to each other;

c. a fluid outlet in communication with the first fluid holding tank for connecting the first fluid holding tank to a high pressure pump intake for injecting said first volume of fresh water into said inlet port of said oil field storage tank for creating said slurry;

d. a fluid pathway for transferring a volume of water from the oil field storage tank into the first, second and third tanks; and e. means for mixing chemicals into said first and second aqueous chemical solutions and a pathway of chemical injection for injecting the first and second aqueous chemical solutions into said volume of water from the oil field storage tank.

2. The apparatus of claim 1, wherein said means for mixing chemicals into the first and second aqueous chemical solutions comprises:

a. a plurality of mixing paddles fixed radially around an axis of rotation, wherein said axis of rotation is located above the centre of each of the second and third tanks;

b. a motor operatively connected to said axis of rotation; and, c. means for controlling the speed of said motor.

* * * * *